United States Patent [19]

Anderson et al.

[11] 4,215,633

[45] Aug. 5, 1980

[54] ACOUSTIC EMISSION CONTACT FUZE WITH SIGNAL PROCESSING CAPABILITY

[75] Inventors: Matthew E. Anderson, Ridgecrest; Timothy P. Zvada, Lake Isabella; Jack T. Waller, Jr., China Lake, all of Calif.

[73] Assignee: The United States of America as represented by the Secretary of the Navy, Washington, D.C.

[21] Appl. No.: 912,680

[22] Filed: Jun. 5, 1978

[51] Int. Cl.[3] ..... F42C 11/02

[52] U.S. Cl. ..... 102/210

[58] Field of Search ..... 102/210, 207; 340/16 R; 73/587

[56] References Cited

U.S. PATENT DOCUMENTS

| | | | |
|---|---|---|---|
| 3,196,794 | 7/1965 | Meade | 102/210 |
| 3,256,817 | 6/1966 | Rabinow et al. | 102/210 |
| 3,320,890 | 5/1967 | Ciccone et al. | 102/210 |
| 3,359,904 | 12/1967 | Nerheim | 102/210 |
| 3,440,961 | 4/1969 | Fohrmann et al. | 102/210 |
| 3,585,419 | 6/1971 | Bourges | 102/210 |
| 3,713,127 | 1/1973 | Keledy et al. | 73/587 |
| 3,756,157 | 9/1973 | England et al. | 102/210 |
| 3,815,505 | 6/1974 | Roh et al. | 102/210 |
| 3,906,493 | 9/1975 | Adrian et al. | 102/214 |
| 3,913,101 | 10/1975 | Adrian | 102/214 |
| 3,924,456 | 12/1975 | Vahaviolos | 73/587 |
| 3,946,600 | 3/1976 | Rettig et al. | 73/587 |
| 4,009,463 | 2/1977 | Vercellotti et al. | 340/16 R |
| 4,036,057 | 7/1977 | Morais | 73/587 |

*Primary Examiner*—Charles T. Jordan

*Attorney, Agent, or Firm*—R. S. Sciascia; W. Thom Skeer

[57] ABSTRACT

An acoustic emission contact fuze that is responsive to high-frequency acoustic emission stress waves and distinguishes between such waves caused by impacts and signals caused by the operating environment.

10 Claims, 4 Drawing Figures

ACOUSTIC EMISSION CONTACT FUZE WITH SIGNAL PROCESSING CAPABILITY

BACKGROUND OF THE INVENTION

1. Field of the Invention

The present application relates to acoustic emission contact fuzes for missiles and, more particularly, to an acoustic emission contact fuze with signal processing capabilities.

2. Description of the Prior Art

Piezoelectric contact fuzes are well known in the art. The fuzes presently in use are sensitive only to direct impacts and are not sensitive to glancing blows or contact where only a portion of the missile is involved.

The conventional methods used to increase the sensitivity to glancing blows are such means as wires on the outside surfaces of the fins, or accelerometers of increased sensitivity. The wires are separated from fin structure surface by a thin layer of a crushable insulator. Upon an impact with a target a short circuit is created which triggers a detonator. The fragility of this system requires extra precautions in the shipping and handling of the missiles such as the use of fin guards. In addition, a check must be made of damage to the structure immediately prior to firing.

Accelerometers consisting of a piezoelectric material with a mass attached have also been used. Increasing the sensitivity of the accelerometer can provide some reaction to glancing blows. As the sensitivity is increased however, environmental factors can lead to false contact signals.

It has been proposed that a fuze could be constructed by placing a piezoelectric transducer on the structural elements of the missile linked to the fin structure. When an impact occurs with the fin structure the supporting structure would be deformed. Deformation of the structure would bend the piezoelectric crystal causing an electrical signal which could be detected. The signals then could be used to trigger the warhead. Previously such attempts have been unsuccessful due to sensitivity to normal vibration or motor-chuffing in flight. These prior configurations have been limited to stress waves of a frequency below that utilized by the claimed invention.

Major disadvantages of present techniques are insensitivity to glancing blows and/or sensitivity to flight environmental conditions and the requirement of extra handling precautions.

SUMMARY OF THE INVENTION

Accordingly, the present invention provides a piezoelectric transducer located so as to be sensitive to high-frequency acoustic emission stress waves. Signal processing circuitry is connected to the transducer to distinguish waves caused by the plastic deformation of missile structures from those caused by normal vibrations in flight or motor chuffing.

DESCRIPTION OF THE PREFERRED EMBODIMENT

When a material is deformed to failure by loading acoustic emission stress waves are generated due to crystal slippage. Acoustic emission stress waves were not researched fully until the late 1960's. The waves generated are of frequencies from 100 KHz to 1 MHz. These waves were not utilized until that date due to the insensitivity of prior art piezoelectric devices to frequencies above a few tens of KHz. The claimed invention comprises a method for detection of these waves, and separation of the signals generated by these waves from noise and other aoustic signals, and the use of the processed signal to trigger a fuze device.

Any plastic deformation of a metal causes the generation of acoustic emission stress waves. These waves are much higher in frequency than acoustic waves generated by wind buffeting or motor-chuffing. The invention distinguishes acoustic emission stress waves by their higher frequency and amplitude from signals caused by the operating environment.

Figure 1:
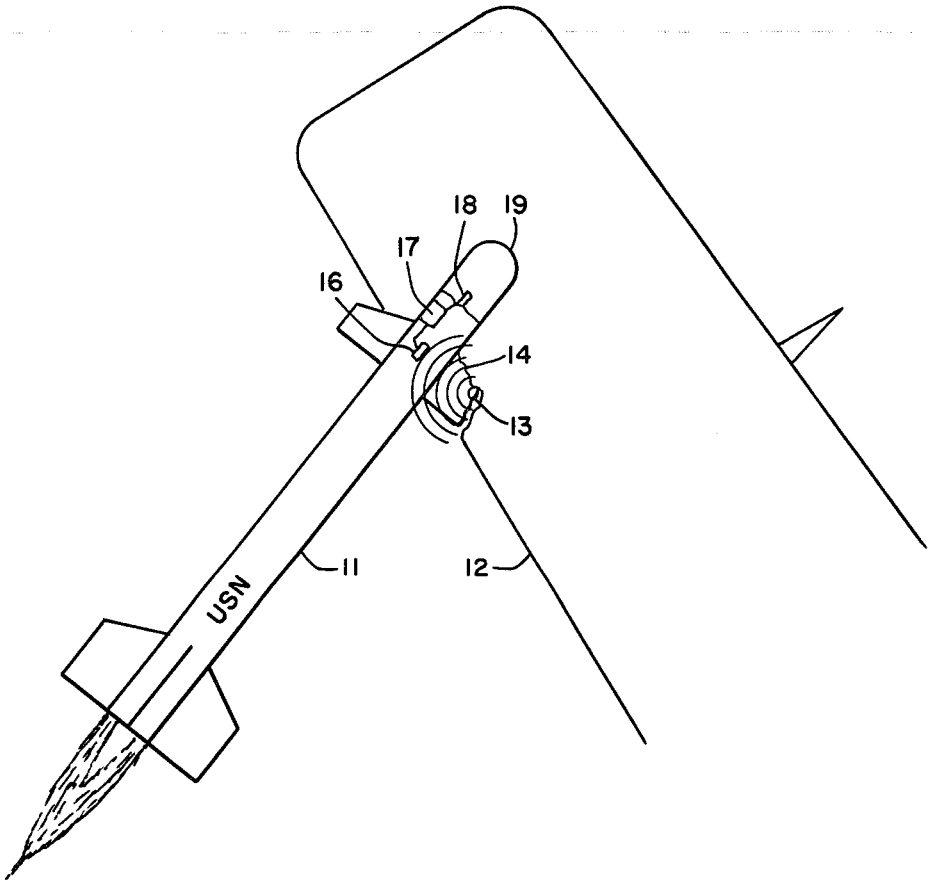
FIG. 1 is an illustration of the invention in a working environment.

In FIG. 1, a missile 11 collides with a target 12. A fin 13 of the missile is damaged in the collision. The deformation of the fin's metal generates acoustic emission stress waves 14. The waves are detected by a piezoelectric transducer 16. The transducer's signal is then fed to the signal processor 17 which on receipt of acoustic emission stress waves fires a squib 18 which detonates the warhead 19 of the missile.

Figure 2:
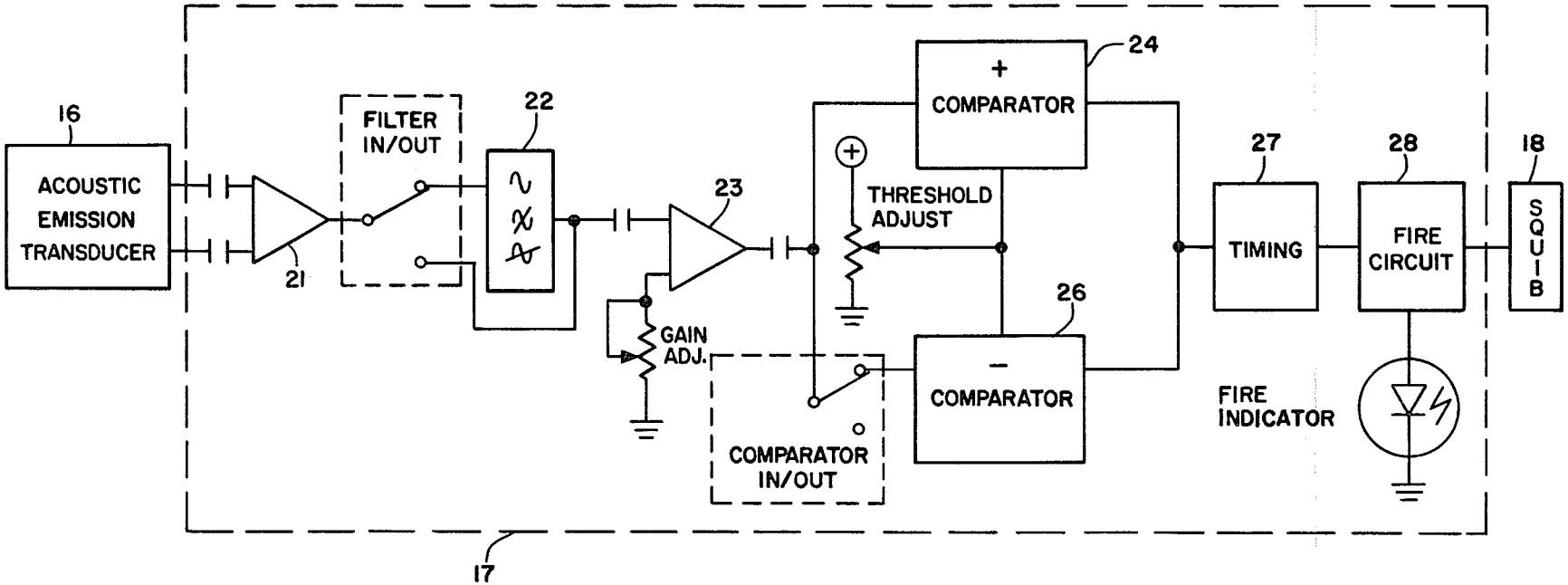
FIG. 2 is a block diagram of the elements of the inventors' preferred embodiment.

A block diagram of the signal processor 17 is shown in FIG. 2. The signal from the transducer first goes to an amplifier 21 which raises it to a level suitable for processing. The signal then enters a bandpass filter 22 and those portions within the range of the filter, here 100 KHz to 1 MHz, are amplified in a post amplifier 23. The signal is now measured against a preset reference by the window comparator 24 and 26. Those signals above the threshold go on to the timer 27. The timer 27 is set to pass a signal to the firing circuit 28 if the timer receives two pulses in 12.5 microseconds. The firing circuit 28 functions as a switch to fire an explosive squib 18 on receiving a signal from the timer.

Figure 3:
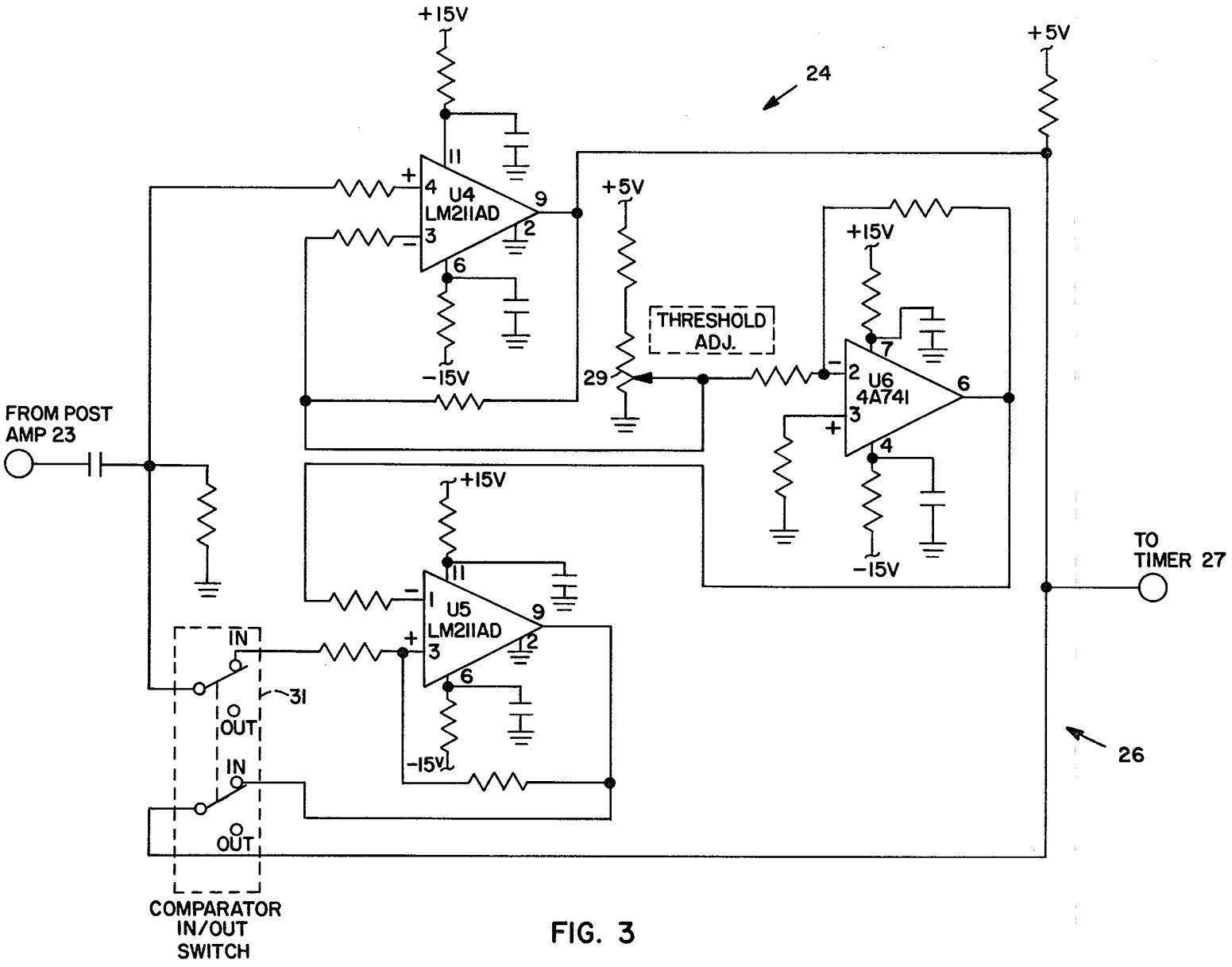
FIG. 3 shows the comparator circuit.

The schematic diagram of the comparator circuit is shown in FIG. 3. The voltage level of the signal required to generate output pulses from window comparator 24, 26 is preset by adjustment of a potentiometer 29. Detection of both the positive and negative parts of a sinusoidal input signal can be accomplished by placing the comparator "in/out" switch 31 in the "in" position. When the switch is in the "out" position, the comparator will detect only positive going signals. When the input at pin 4 of U4 or pin 3 of U5 exceeds the preset threshold the output voltage at pin 9 of U4 and U5 switches from 2.0–4.0 VDC to 0–0.8 VDC. The width of the output pulse will remain at this voltage level for the length of time that the input voltage exceeds the preset threshold.

Figure 4:
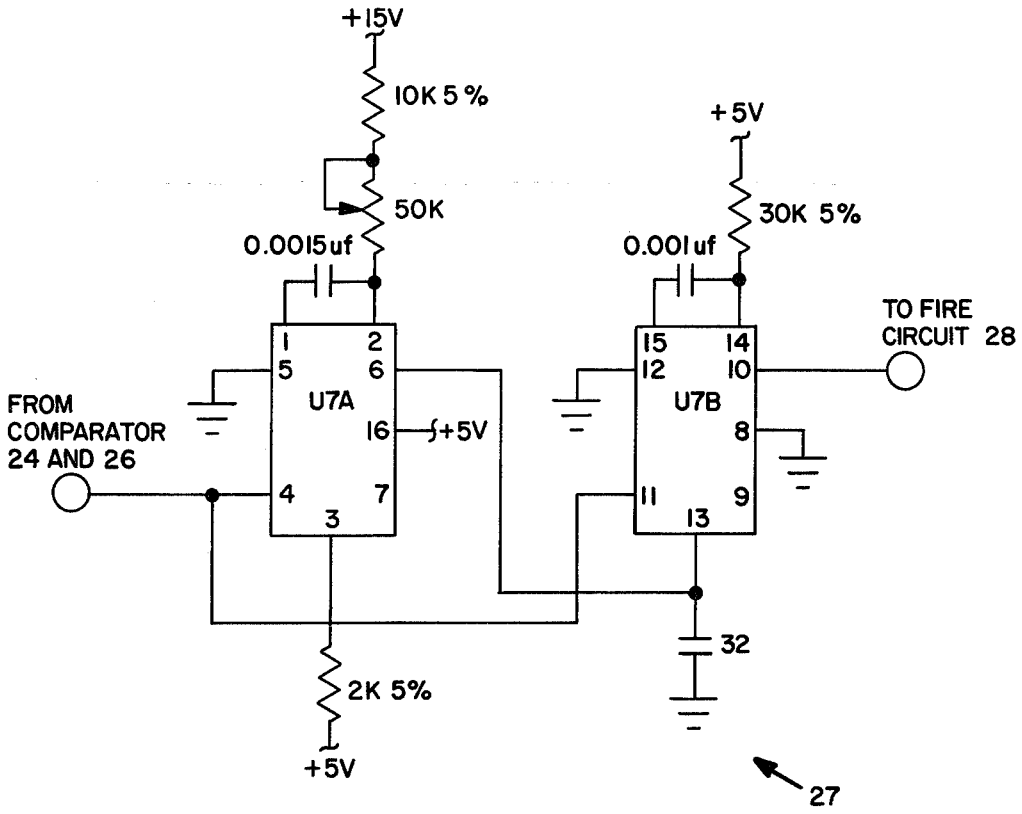
FIG. 4 shows the timing circuit.

FIG. 4 is a circuit diagram of the timing gate.

If two pulses, either positive or negative are fed to the input of the comparator (comparator in/out switch in the "in" position), a "fire" pulse will be generated at pin 10 of U7B. This is accomplished when a negative going signal into pin 4 of U7A produces a positive going signal at pin 6 of U7A. This positive going signal is fed to pin 13 of U7B. The charging time of the capacitor 32 holds pin 13 at a "O" logic level and as a consequence the output at pin 10 is held to a logic "O". Where the second negative going pulse is fed to pin 4 of U7A and pin 11 of U7B, capacitor 32 is charged thereby driving the input of pin 13 with a "I" logic level and the output at pin 10 is switched to a "I" logic level.

The most recent embodiment of the invention consists of a piezoelectric transducer 16 mounted securely and acoustically coupled to a portion of a guided missile airframe 11. The location is generally within the missile structure at a point close to the portion of the missile which is most often expected to impact with the target, such as missile wings or nose. Transducer 16 has no external mass connected to the crystal to allow function as an accelerometer but functioning rather as an acoustic emission stress wave transducer. The output of transducer 16 is processed by a solid-state circuitry 17, previously described in reference to FIG. 2. The bandpass filter 22 is designed to pass signals of extremely high frequency and prevent the transmission of lower frequency signals. In the disclosed embodiment of the invention the bandpass filter is an active filter. Bandpass filter 22 thus ensures that only signals in the frequency range of acoustic emission stress waves will be processed. The output of bandpass filter 22 is amplified and transmitted for further signal processing. The signal then enters window comparator 24, 26 and only pulses that are above a set magnitude pass. These pulses are analyzed in timer 27 and if two pulses are received in 12.5 microseconds, indicating the high frequency of acoustic emission stress waves, firing circuit 28 is activated causing detonation of squib 18 and the warhead.

The signal processing means herein described are the most recent method of detecting the acoustic emission stress waves and distinguishing them from environmental signals. Alternative signal processing means are possible and within the skill of the proficient engineer recognizing well-understood trade-off's. It is likely that future development of the invention may utilize other signal processing means, within such scope. The circuit configuration given is a preferred means of accomplishing this end and constitutes the best mode of practicing the invention presently contemplated.

What is claimed is:

1. A detector to respond to impacts comprising;

transducer means attached to a vehicle for producing an electrical output upon receipt of acoustic emission stress waves;

filter means effectively connected to said transducer means and following said transducer means on the signal path to separate acoustic emission stress waves from other signals by frequency;

threshold means effectively connected to said filter means and following said filter means on the signal path to pass signals resulting from acoustic emission stress waves;

timing means connected to said threshold means and following said threshold means on the signal path to measure the coincidence of signals within a given time;

response means operatively connected to said timing means and following said timing means on the signal path.

2. A detector to respond to impacts as in claim 1 where said filter means is an active bandpass filter.

3. A detector to respond to impacts as in claim 1 where said threshold means is a window comparator.

4. A detector to respond to impacts as in claim 1 where said transducer is a piezoelectric transducer.

5. A detector to respond to impacts as in claim 1 where said response means is a firing circuit and squib.

6. A detector to respond to impacts as in claim 1 where the effective connection between said transducer means and said filter means includes an amplifier.

7. A detector to respond to impacts as in claim 1 where the effective connection between said threshold means and said filter means includes a post amplifier.

8. A detector to respond to impacts as in claim 1 where the operative connection between said timing means and said response means includes a firing circuit.

9. A detector to respond to impacts as in claim 2 where said threshold means is a window comparator.

10. A detector to respond to impacts as in claim 2 where said transducer is a piezoelectric transducer.

* * * * *